US005447145A

United States Patent [19]

Cappello et al.

[11] Patent Number: 5,447,145

[45] Date of Patent: Sep. 5, 1995

[54] DOOR OF A FOOD COOKING OVEN

[75] Inventors: Massimo Cappello, Venice; Bruno Levi, Pordenone, both of Italy

[73] Assignee: Zanussi Grandi Impianti S.P.A., Pordenone, Italy

[21] Appl. No.: 303,488

[22] Filed: Sep. 9, 1994

[30] Foreign Application Priority Data

Sep. 17, 1993 [IT] Italy ..... PN93A0062

[51] Int. Cl.[6] ..... A21B 1/08

[52] U.S. Cl. ..... 126/20; 126/200; 126/383; 126/194

[58] Field of Search ..... 126/20, 21 R, 190, 198, 126/194, 200, 348, 369, 383–386; 219/401

[56] References Cited

U.S. PATENT DOCUMENTS

| | | | |
|---|---|---|---|
| 2,214,425 | 9/1940 | McNamara | 126/20 |
| 3,186,401 | 6/1965 | Mayer et al. | 126/200 |
| 3,489,135 | 1/1970 | Astrella | 126/200 |
| 4,641,630 | 2/1987 | Meister | 126/20 |

*Primary Examiner*—James C. Yeung

*Attorney, Agent, or Firm*—Pearne, Gordon, McCoy & Granger

[57] ABSTRACT

A food cooking oven having a vertically hinged access door 1 provided with an exterior glazing 2, and an inner door 3 arranged on the inner face of said door. The inner door is provided with a hinge 4 along the hinging edge of the access door 1 to the oven housing and is able to be turned with respect to the hinge to a position which is moved away and separated from said access door. The oven also includes a gutter 6 for collecting condensation water and other drippings. The gutter runs along the lower edge of the access door and is provided with a liquid shut-off means 7. A liquid collecting element 11 is arranged so as to protrude from the lower side 10 of the oven cavity opening perimeter, in a position lying underneath said liquid shut-off means, the latter being normally shut when the oven door is open, and adapted to close automatically when the door is being closed.

3 Claims, 4 Drawing Sheets

DOOR OF A FOOD COOKING OVEN

BACKGROUND OF THE INVENTION

The present invention relates to an improvement enabling better cleaning of the inner door glass pane of a food cooking oven, in particular, an oven for professional kitchens and similar catering applications, as well as for enhancing moisture removal from said inner door glass pane.

It is widely known that in food cooking ovens that use steam as a cooking medium, the whole cooking cavity is filled with such steam. If a sufficiently low temperature prevails in the cooking cavity, the steam condenses on the food, on the interior walls of the cavity and, in particular, on the inner face of the front glazing of the door, which are therefore wetted copiously.

When the oven door is closed, steam condensate collects on the bottom of the cooking cavity, where appropriate conduits are provided to convey it outside the cooking cavity. When the door is then opened, the water formed by condensation inside the door starts dripping on the floor in an uncontrolled way. This, as it may easily be appreciated, not only constitutes a hygiene problem, but also represents a risky situation, since a wet floor becomes slippery and, therefore, dangerous for personnel working nearby.

U.S. Pat. No. 4,641,630, for example, shows an arrangement having, along the lower edge of the door, a channel which extends along the width of the same door. Near the lower hinge thereof, an outlet opening is provided onto a condensate collecting gutter, said gutter being arranged externally of the door, along the lower edge thereof.

Therefore, condensation water dripping off the opened door is collected by such a gutter and conveyed to the drain through such an opening, so that no water leakage takes place in the area where the oven is installed. In order to keep such a water collecting arrangement as compact as possible dimensionally, the outlet opening is aligned with the axis of the pivot of the door.

Such an arrangement, albeit quite effective and simple, has however a main drawback. The outlet opening between said gutter and the underlying collecting channel situated beneath the lower edge of the oven cavity opening has the drawback of becoming quite easily obstructed either by solid or fat cooking residues and debris which are flushed off the door glazings and carried away by condensate water during each cooking operation or by food particles that may accidentally fall into such a gutter.

In order to avert the occurrence of such a drawback, it would of course be possible to provide a larger outlet opening, but this would be clearly in contrast with the need of keeping the thickness of the gutter as narrow as possible.

It is furthermore a common experience of all oven operators and users that fumes and vapors generated during food cooking operations tend to seep into the hollow space existing between the outer glass pane and the inner glass pane of the door, thereby depositing tiny particles of solid residues and debris there, which will eventually heavily soil the opposing glazings. This gives rise to two distinct types of problems. First of all, this occurrence creates a hindrance tending to prevent an outside observer from adequately looking through at the food being cooked inside the oven cavity, thereby making the provision of a double door glazing, ie. a viewing window, useless. The second and far more serious problem derives from the fact that the same presence of such food debris in the hollow space between the door glazings will eventually trigger putrefaction and fermentation processes, with clearly perceivable, obvious consequences on the hygienic conditions and safety in the use of the oven itself.

For this particular portion of the oven to be kept clean in a systematic and effective way, it therefore would be necessary that a portion of the door be systematically disassembled so as to enable someone to reach and clean the outward facing surface of the inner door glazing, as well as the inward facing surface of the outer door glazing. However, this operation would prove time-consuming and require a quite careful handling on the part of the kitchen worker that normally is fully devoted to other, more important tasks. Furthermore, the worker may not be the most qualified to carry out mechanical disassembly operations, however simple they might be.

SUMMARY OF THE INVENTION

The need arises, therefore, of creating the possibility for the interior of said hollow space between the door glazings to be readily and quickly reached, so as to enable cleaning of said soiled surfaces accordingly. Also needed are means, preferably automatically operating ones, that are effective in keeping free and unobstructed the opening provided to let condensate liquids from said gutter into the collecting channel situated thereunder.

It is therefore a main purpose of the present invention to improve the construction of said cooking ovens of the afore-specified kind by providing them with arrangements capable of eliminating the described drawbacks, with no need arising for major construction modifications to be implemented or demanding measures to be taken in the concerned appliances.

The above cited arrangements are implemented with the features that are substantially described with particular reference to the appended claims.

BRIEF DESCRIPTION OF THE DRAWINGS

The invention itself will be more readily understood on the basis of the description given below by way of non-limiting example with reference to the accompanying drawings, in which.

DETAILED DESCRIPTION OF THE PREFERRED EMBODIMENTS

Figure 1A:
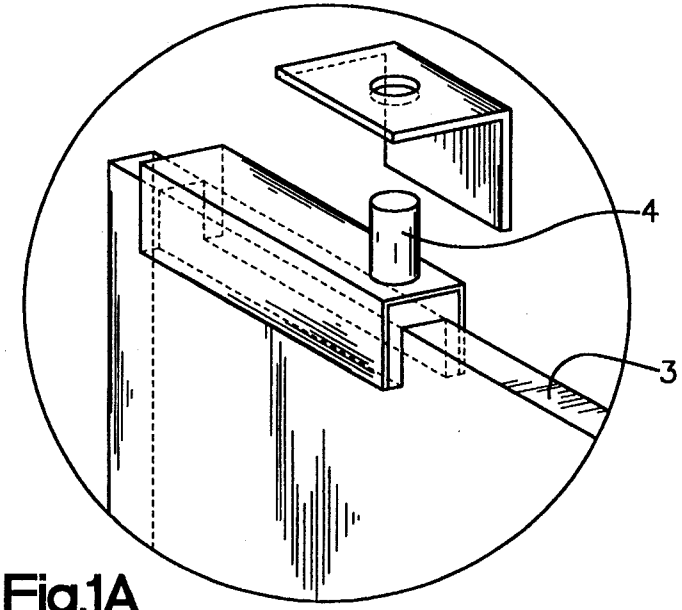
FIGS. 1A, 1B, 2A and 2B are detailed views of FIGS. 1 and 2.
Figure 1B:
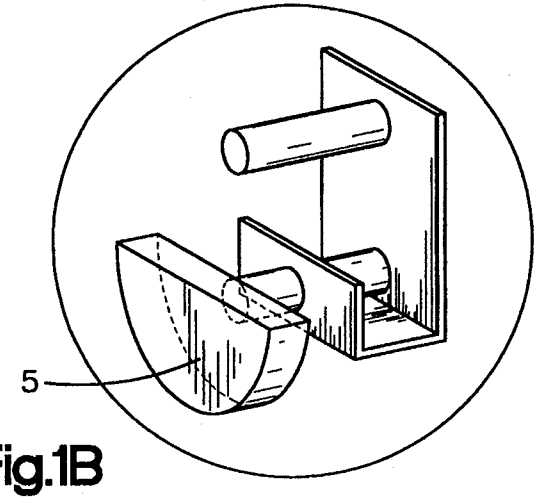
Figure 1:
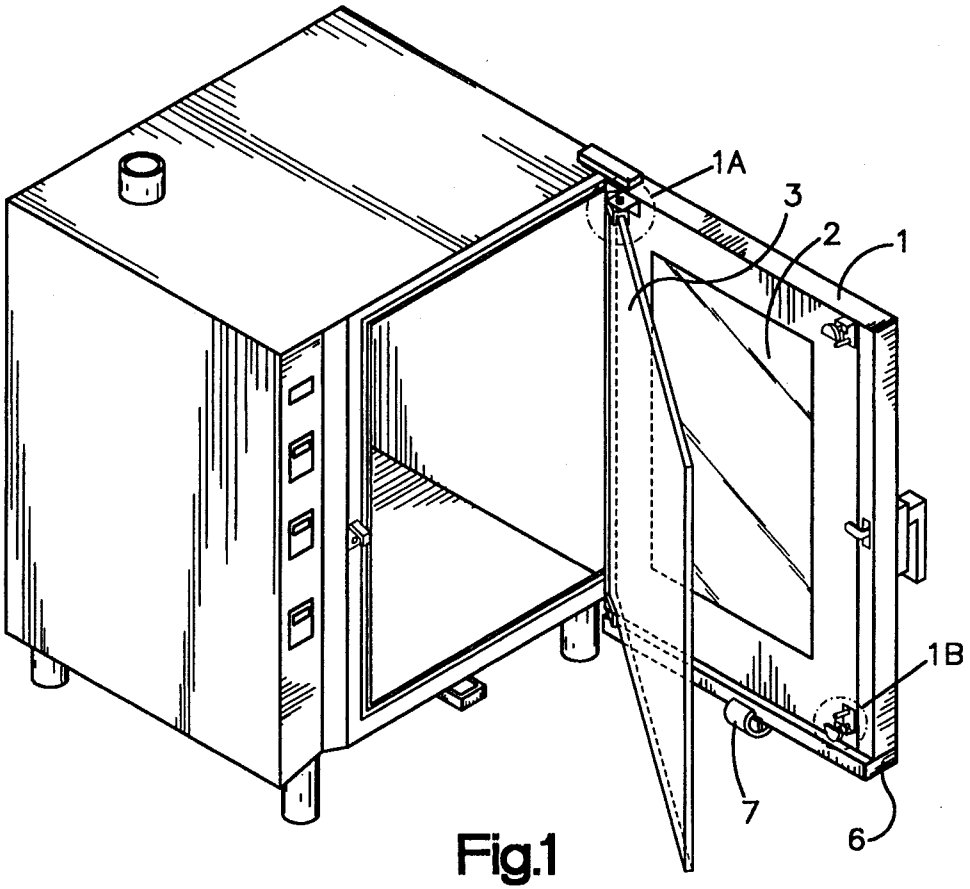
FIGS. 1 and 2 are perspective views showing schematically a cooking oven embodying arrangements according to the present invention, as applied to the inner portion of a door assembly.
Figure 2A:
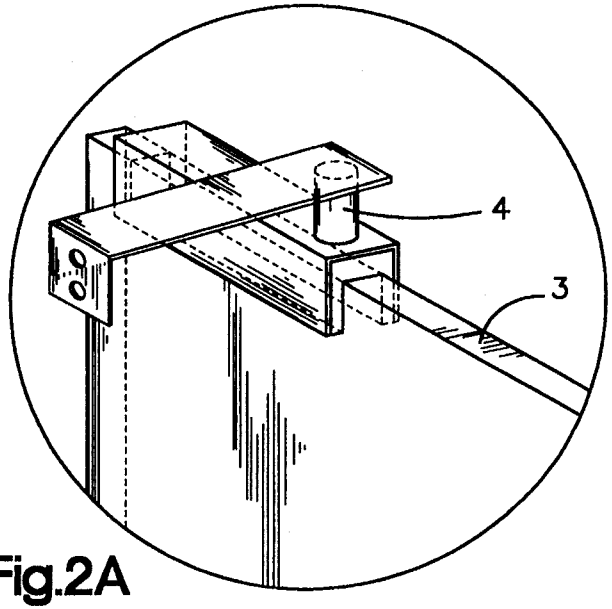
Figure 2B:
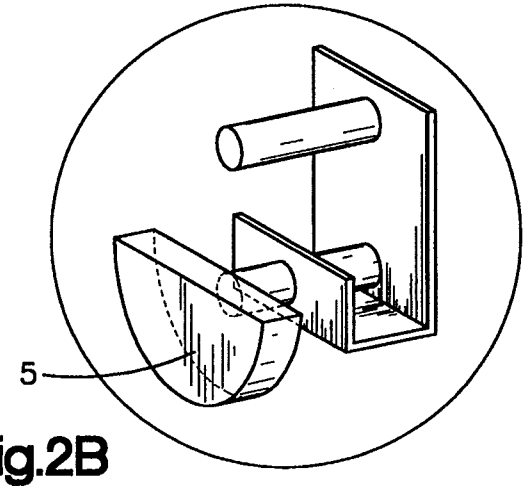
Figure 2:
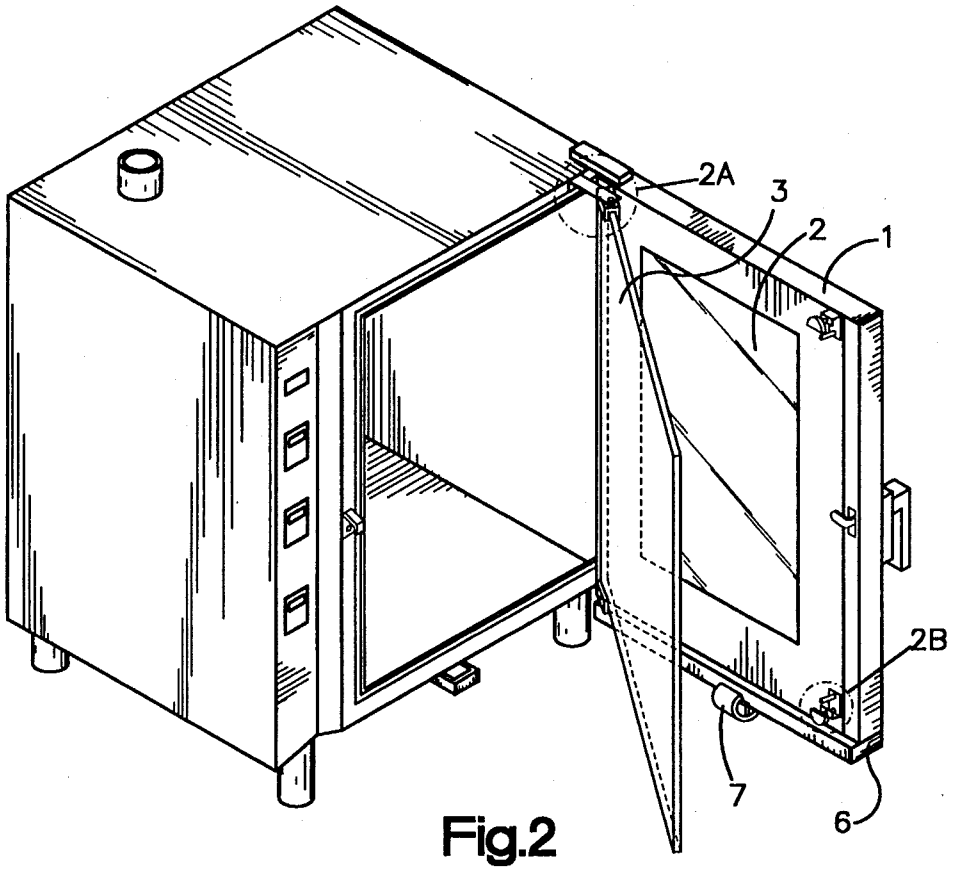

Referring to FIGS. 1 and 2, a food cooking oven for use in professional kitchens or similar applications is provided with a loading door 1 that can be opened in a "book-like" manner, ie. by turning it about its vertical axis.

The central portion of said door assembly is normally closed by a glass pane 2. Inwardly, the same door assembly is provided with an inner door 3, which also consists of a glass pane and is applied by attaching it to the same door.

Figure 4:
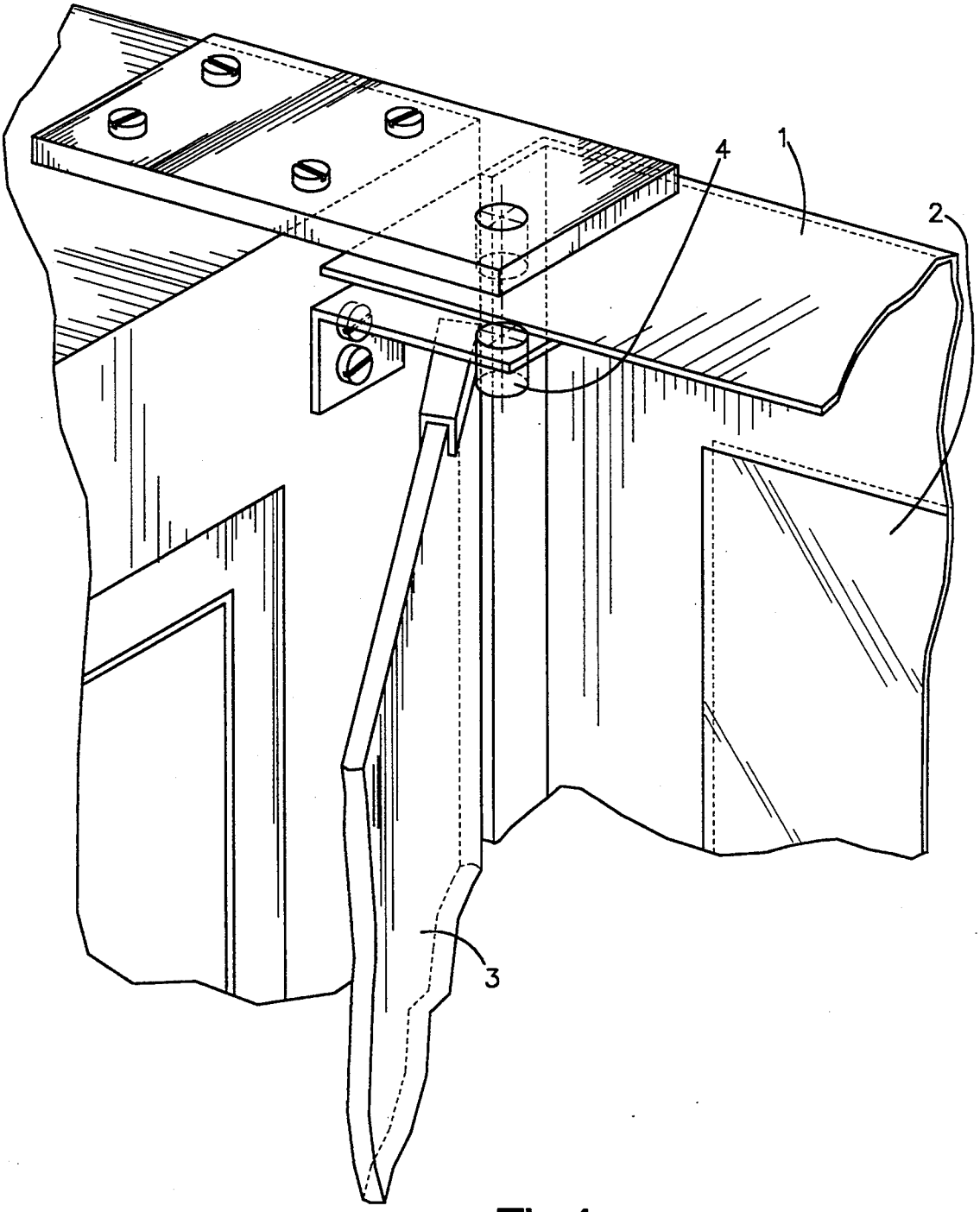

Referring to FIGS. 1A, 2A, and 4, this may be achieved according to the present invention by providing said inner door 3 with at least a hinge 4 along the hinging edge of the oven door, so as to enable said inner door to turn in a "book-like" manner relative to the structure of the same door.

Said hinge 4 supporting the inner door may preferably be mounted against the inner edge of the structure of the door, but it can equally well be arranged on the outer vertical rabbet adjacent to the oven cavity opening, on the same side of the hinges that support the door, as shown for instance in FIG. 2.

Such a particular arrangement has the advantage of preventing the structure of the door, and therefore the corresponding hinges, from having to bear also the weight of said inner door. On the other hand, it would also require that the door and said inner door be actually prevented from mutually sliding relative to each other during opening and closing movements.

However, such a sliding of the door relative to the inner door can be avoided by arranging the hinges of the door and the inner door one the same geometrical axis of rotation, as shown in FIG. 4 and as anyone skilled in the art would be able to easily appreciate and implement.

As shown in FIGS. 1B and 2B, under normal conditions of use, said turning inner door 3 is kept in position relative to the door by at least a catch 5, such as for instance a rotation-type catch. The catch may be arranged in different positions between an edge of said inner door and the structure of the door and shall further be capable of being actuated simply, readily and reliably.

While the need of actually cleaning said hollow space of the door assembly only arises after a certain number of oven utilizations, ie. after a longer period of use, condensate tends to build up on the inner walls of said hollow space between the door and inner door during each cooking cycle and this leads to a systematic, heavy dripping from the inner edge of the door when the latter is opened. As a consequence, the need arises of providing a corresponding gutter to collect such drippings, as this has already been set forth in the afore-cited U.S. Patent specification. Thus, the possibility exists for the outlet opening to become obstructed, as mentioned previously.

Figure 3:
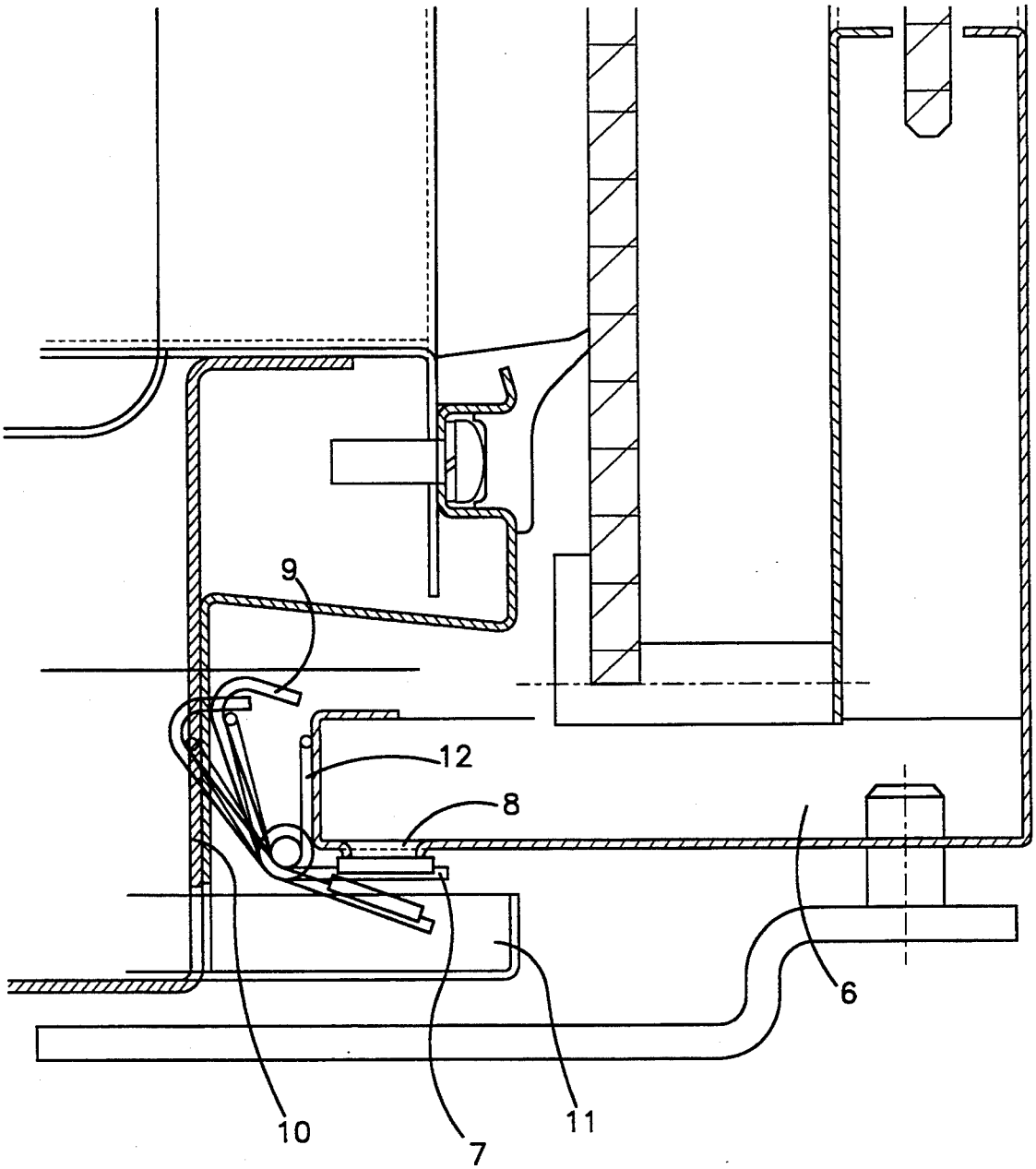
FIGS. 3 and 4 are detail views of two particular features of the arrangements according to the present invention.

Referring again to FIGS. 1, 2, and 3, in order to avert such a drawback, a lower condensate collecting gutter 6 is provided with a shut-off means 7 for liquids, which is constituted essentially by a valve whose head is adapted to communicatingly connect the inner side of said drip collecting gutter with an outlet opening 8 of said liquid shut-off means 7, and whose stem 9 is made to project toward the inner side of the door and is arranged in such a position and given such a size that it is capable of abutting against the lower edge 10 of the portion surrounding the oven cavity opening, as shown in FIG. 3.

Said valve is further provided with a spring means 12 that is arranged in such a way that, when the door is open and the stem is therefore in an inert condition, it is adapted to keep the passage opening closed. Whereas, when the door is closed, the pressure exerted on the valve by the stem 9 following its abutting against said lower edge 10 causes the valve head to be displaced from its resting position, so that the flow passage from the inner side of the gutter 5 to the afore-cited outlet opening 8 is opened, ie. set free. The liquid collected inside said gutter is discharged into an appropriate collecting means 11 which is preferably given a funnel-like shape and protrudes from said lower edge 10 in a position lying underneath said outlet opening of the liquid shut-off means 7 when the oven door is closed.

It will be then clearly appreciated that said liquid shut-off means is opened only when the oven door is closed, thereby enabling condensate to automatically flow from the gutter into the drip collecting means 11 only when the oven door is closed. When the oven door is opened, said liquid shut-off means is on the contrary closed, thereby preventing the liquid from flowing therethrough. An advantage of such an arrangement derives from the fact that by frequently opening and closing the oven door, as normally occurs in practical use, the stem and the head of the valve of the liquid shut-off means are actuated in a corresponding frequent manner and such movements of the valve elements in the valve seat therefore enable possible cooking debris collected thereinto to be removed therefrom and, as a consequence, the valve to be kept clean and unobstructed. This again ensures the liquid shut-off means to be kept uninterruptedly clean and properly operating.

Anyone skilled in the art will at this point be able to appreciate a further advantage of the present invention. As a matter of fact, it is fully possible to select any suitable position, and in particular the constructively ideal position for any given oven design, for the drip collecting means 11. The need no longer arises for the collecting means to be necessarily situated under the door hinge owing to the fact that the afore-cited liquid shut-off means can actually be freely positioned at any desired point along the gutter.

Furthermore, the turning movement of the door impresses upon the liquid collected in the gutter a centrifugal motion towards the outer side of the gutter, thereby promoting the outlet of the same liquid from the gutter if the liquid shut-off means is located in an outer position, whereas said liquid outlet is on the contrary hindered with the arrangement disclosed in the afore-mentioned U.S. patent specification, since the inner position of the outlet opening, by inducing the liquid to collect towards the exterior of the gutter, makes the liquid flow path actually longer and the removal of the liquid therefrom more difficult.

It will be widely appreciated that, although it has been described here as an example with reference to the accompanying Figures, the present invention may be the subject of any of a number of possible constructional modifications and different embodiments, as may appear to be appropriate, without departing from the scope of the invention.

What is claimed is:

1. A food cooking oven having an oven cavity opening surrounded by a portion of the oven having a lower edge, said oven comprising an access door (1) vertically hinged to close the oven cavity opening and provided with an exterior glazing (2), an inner door (3) arranged on an inner face of said access door, and a gutter (6) for collecting condensate along a lower edge of said access door, characterized in that:

said gutter is provided with a liquid shut-off means (7) preventing liquid from draining from the gutter;

a liquid collecting means (11) is arranged so as to protrude from the lower edge (10) of the portion of the oven surrounding the oven cavity opening, in a position beneath said liquid shut-off means; and said liquid shut-off means is normally closed when the oven access door is open, and opens automatically when said oven access door is closed.

2. A food cooking oven according to claim 1, characterized in that said liquid shut-off means (7) comprises a head, a stem (9) projecting inwardly from the oven door, connected to operate the head and adapted to engage against said lower edge (10) of the portion surrounding the oven door, an outlet opening (8) of the gutter adapted to communicatingly connect the interior of said gutter with said liquid collecting means (11) when the oven door is closed, and a spring means adapted to keep said liquid shut-off means normally closed by closing the outlet opening with the head when the stem is disengaged from the lower edge of the portion surrounding the oven door.

3. A food cooking oven according to claim 1, wherein the liquid collecting means is in the shape of a funnel.

* * * * *